US006855104B2

(12) United States Patent
Schmid et al.

(10) Patent No.: US 6,855,104 B2
(45) Date of Patent: Feb. 15, 2005

(54) IMPLANTABLE TRANSDUCER FOR HEARING AIDS AND PROCESS FOR TUNING THE FREQUENCY RESPONSE OF ONE SUCH TRANSDUCER

(75) Inventors: Christoph Schmid, Zollikofen (CH); Hans Bernhard, Koeniz (CH); Zbynek Struzka, Portalban (CH)

(73) Assignee: Phonak AG, Stafa (CH)

( * ) Notice: Subject to any disclaimer, the term of this patent is extended or adjusted under 35 U.S.C. 154(b) by 15 days.

(21) Appl. No.: 10/420,748

(22) Filed: Apr. 23, 2003

(65) Prior Publication Data

US 2004/0097785 A1 May 20, 2004

(30) Foreign Application Priority Data

Nov. 20, 2002 (EP) ..... 02025939

(51) Int. Cl.[7] ..... H04R 25/00
(52) U.S. Cl. ..... 600/25
(58) Field of Search ..... 600/25, 559; 151/126–137; 181/126, 128, 129, 130, 134, 135; 381/68–69.2, 411–415, 400, 430, 398, 423, 424, 432; 607/55–57, 136, 137

(56) References Cited

U.S. PATENT DOCUMENTS 4,628,907 A 12/1986 Epley
5,299,176 A 3/1994 Tibbetts
5,624,376 A * 4/1997 Ball et al. ..... 600/25
5,941,814 A * 8/1999 Lehner et al. ..... 600/25
6,139,488 A 10/2000 Ball
6,162,169 A 12/2000 Leysieffer
6,190,305 B1 * 2/2001 Ball et al. ..... 600/25
6,208,743 B1 * 3/2001 Marten et al. ..... 381/415
6,217,508 B1 * 4/2001 Ball et al. ..... 600/25
6,540,661 B1 * 4/2003 Muller ..... 600/25
2001/0055405 A1 12/2001 Cho

OTHER PUBLICATIONS

European Search Report Dated Nov. 27, 2003.
H. Leysieffer et al. "Ein implantierbarer piezoelektrischer Hörgerätewandler für Innenohrschwerhörige" *HNO* Oct. 1997, pps. 792–794.

* cited by examiner

*Primary Examiner*—Samuel G. Gilbert
*Assistant Examiner*—Nikita R. Veniaminov
(74) *Attorney, Agent, or Firm*—Nixon Peabody LLP; David S. Safran

(57) ABSTRACT

An implantable electromagnetic transducer for hearing aids and process for tuning its frequency response are disclosed. The transducer is provided with a static transducer part which includes a hermetically sealed transducer housing and a ring coil arrangement which is mounted inside, and with a dynamic part which is mechanically connected to the static transducer part via at least one connecting element which is coupled in the implanted state to part of the body of the implant wearer via at least one connecting element. The implantable transducer has a permanent magnet arrangement, which interacts with the ring coil arrangement and which is supported to be able to vibrate by means of a support in the direction of the axis of the ring coil arrangement, with at least one connecting element being made as a multifunction element which is part of the support and/or part of the hermetically tight transducer housing. The mechanical properties of the multifunction element are selected for achieving a set frequency response of the transducer.

19 Claims, 3 Drawing Sheets

Fig. 3
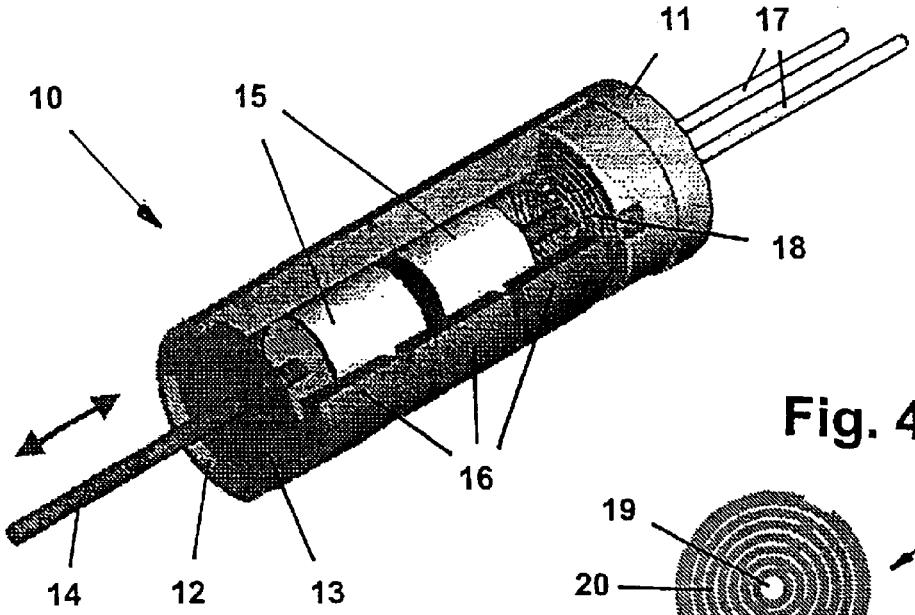
Fig. 4
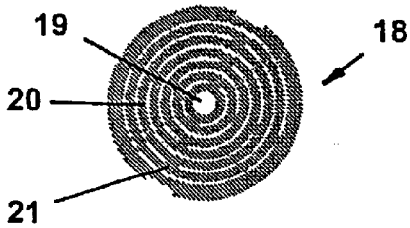
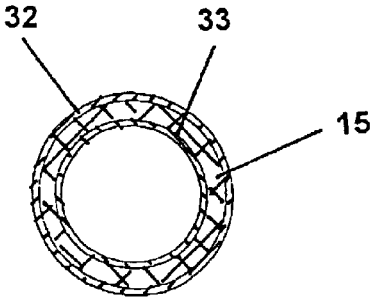
Fig. 9
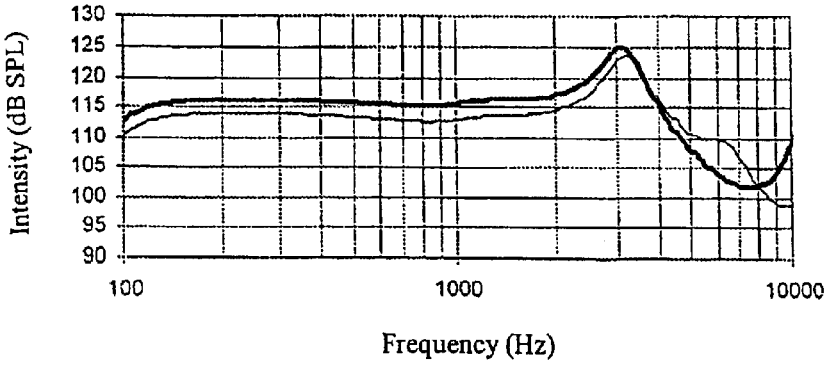
Fig. 7

IMPLANTABLE TRANSDUCER FOR HEARING AIDS AND PROCESS FOR TUNING THE FREQUENCY RESPONSE OF ONE SUCH TRANSDUCER

BACKGROUND OF THE INVENTION

1. Field of the Invention

The invention relates to an implantable transducer for hearing aids which transducer operates using the electromagnetic transducer principle, and to a process for tuning the frequency response of the transducer.

2. Description of Related Art

Transducers of this type are known fundamentally, for example, from HNO, 1997-45:792–800, H. Leysieffer et al. "An implantable piezoelectric hearing aid transducer for those suffering from labyrinthine deafness." This article is concerned especially with piezoelectric transducers, it is, however, generally pointed out that actuator hearing aid transducers also can be implemented using the electromagnetic transducer process. That is, in such an electromagnetic transducer a permanent magnet moves in the field of a stationary coil, whose field changes in time, which has the advantage of a miniaturization capacity of the movable permanent magnet.

One embodiment of an electromagnetic transducer which is designed for an at least partially implantable hearing aid for direct mechanical excitation of the middle ear or inner ear is described in U.S. Pat. No. 6,162,169. This patent discloses a permanent magnet which is suspended on the inside of a membrane and extends into a housing-mounted electromagnetic component, particularly a ring coil. The membrane, which closes the open face side of a hermetically sealed pot-shaped transducer housing, can vibrate. A coupling element for transmission of vibrations to the middle ear and/or the inner ear is mounted on the outside of the membrane.

SUMMARY OF THE INVENTION

The primary object of the invention is to devise an implantable transducer for hearing aids which works according to the electromagnetic transducer principle, and which can be especially well adapted to circumstances which arise in practice. The implantable transducer configuration will depend upon its use as an actuator or sensor, on the intended implantation site and similar circumstances. Furthermore, it is also an object of the invention to provide a process for tuning the frequency response of such a transducer.

The structure of the transducer of the invention includes an implantable transducer which works according to the electromagnetic transducer principle for hearing aids. The transducer has a static part which includes a transducer housing, that is hermetically tight on all sides, and a ring coil arrangement which is permanently mounted inside the housing, and has a dynamic part which is mechanically connected to the static transducer part via at least one connecting element. The transducer of the invention is coupled, in an implanted state, to part of the body of the implant wearer via at least one connecting element, and further includes a permanent magnet arrangement which interacts with the ring coil arrangement and is supported to be able to vibrate by means of a support in the direction of the axis of the ring coil arrangement. The at least one connecting element can be a multifunction element, which is part of the support and/or part of the hermetically tight transducer housing, whose mechanical properties are selected for achieving a set frequency response of the transducer.

Furthermore, the invention includes a process for tuning the frequency response of the inventive implantable transducer for hearing aids which works according to the electromagnetic transducer principle.

The present invention proceeds from the requirement for implantable electromechanical actuators to ensure high efficiency. This is especially important in the case of implants since the supply of power supply is often a problem; such that what matters is converting a certain amount of electrical energy into the largest possible amount of mechanical energy. The instant invention is based on the finding that the efficiency with which an actuator transfers energy to the body depends significantly on the matching of the frequency response of the actuator to the load impedance. Therefore, the tuning of the frequency response properties with respect to the impedance of the load which is active on the actuator can have a significant effect on the efficiency of energy transmission from the transducer to the body. In electromechanical sensors what is important is achieving sensitivity and linearity which are as high as possible. The frequency response of the transducer is decisive for this purpose. One common requirement for implantable actuator and sensor transducers for hearing aids is miniaturization since the space which is available for implantation is generally extremely limited. In currently available concepts for implantable transducers, there are no mechanisms which make it possible to systematically tune the frequency response of the same actuator matched to the conditions which can be expected at the implantation site.

This defect is remedied in a simple and effective manner by the invention. By multiple use of individual components of the transducer, the amount of space required for the transducer is kept particularly small. Additionally, the number of required individual parts and installation cost are minimized.

Preferably, at least one multifunction element is a flexible membrane which is used to adjust the set frequency response of the transducer and which provides for mutual elastic connection of the static and dynamic transducer parts as the connecting element and which also forms a wall part of the transducer housing.

The transducer housing can have a rigid tubular peripheral wall and end walls which are tightly connected, with at least one of the end walls being formed by a flexible membrane which is used to adjust the set frequency response of the transducer. The static and dynamic parts of the transducer are elastically connected to one another and form part of the support of the permanent magnet arrangement. In this embodiment, the membrane at the same time assumes four functions. Through a judicious choice of membrane mechanical properties, e.g., the choice of its wall thickness, the membrane is used as a tuning element for the frequency response of the transducer. The membrane provides for, or supports, the connection of the static and dynamic transducer parts, and forms part of the hermetically tight transducer housing. The membrane is also used to support the permanent magnet arrangement which is part of the dynamic transducer part.

At least one of the connecting elements of the transducer of the invention can be designed as an attenuation element for attenuating the vibrational movements of the permanent magnet arrangement. The mechanical properties of the attenuation element can also been chosen with respect to achieving the desired set frequency response.

Additionally, the attenuation element can be at least one membrane which can form part of the bearing arrangement of the permanent magnet arrangement. The attenuation properties of one such membrane, which influences the frequency response of the transducer, can be set not only by a particular choice of the thickness of the membrane wall, but also by the particular choice of a tailored perforation or slitting of the membrane.

The attenuation element, which influences the frequency response of the transducer, can be at least one plug of viscous material which can be supported both relative to the static transducer part and also relative to the dynamic transducer part.

According to a preferred embodiment of the invention, the permanent magnet arrangement is mounted on a rod which is supported to be axially adjustable by means of support at least at two locations which are spaced axially apart with reference to the transducer housing. The rod, when employed as an actuator element, can project out of the transducer housing.

In another preferred embodiment, the permanent magnet arrangement is accommodated in its own, hermetically tight and biocompatible housing.

To achieve the above objects of the invention, the transducer housing can be made cylindrical, for example, circularly cylindrical.

BRIEF DESCRIPTION OF THE DRAWINGS

FIG. 3 shows a cutaway perspective of a hearing aid transducer constructed according to the invention, FIG. 4 shows an overhead view of a second membrane provided in the transducer as shown in FIG. 3, with a bearing function, FIG. 7 illustrates the effect of a membrane of the type shown in FIG. 6 on the transfer function of the acoustic transducer, FIG. 8 shows a side view of a further modified version of the connecting element with an attenuation function and FIG. 9 shows a cross section of a permanent magnet arrangement accommodated in its own housing.

DETAILED DESCRIPTION OF THE INVENTION

Figure 1:
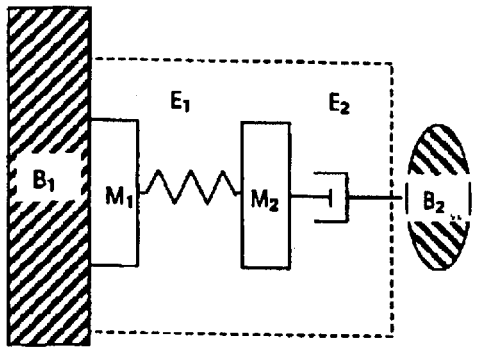
FIG. 1 shows a schematic of an implantable electromechanical hearing aid transducer.
Figure 2:
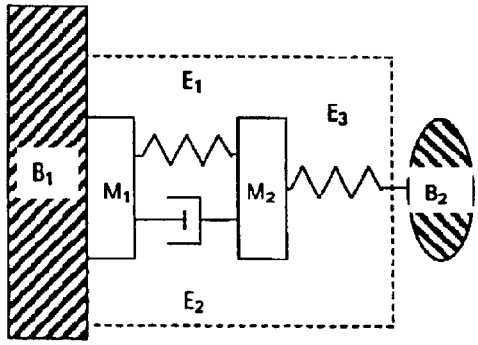
FIG. 2 shows a schematic similar to FIG. 1 for a modified embodiment of the transducer.

The schematics of FIGS. 1 and 2 show, in the block which is framed by the broken lines, a transducer which can be selectively used as an actuator which excites vibrations or a sensor which detects vibrations. $M_1$ is the static part of the transducer. The static transducer part $M_1$ represents an element which in the implanted state is in essentially rigid contact with a body part $B_1$ of the implant wearer, for example, a muscle or bone which has a large mass compared to the mass of the transducer. $M_2$ in FIGS. 1 and 2 represents the dynamic part of the transducer. $M_2$ is in contact with a body part $B_2$ of the implant wearer; its mass or impedance is preferably comparable to the mass or impedance of the transducer. Body part $B_2$ can be the eardrum, a middle ear ossicle, the perilymph or the basilar membrane in the inner ear, especially in the case of an actuator.

In the arrangement shown in FIG. 1, the static transducer part $M_1$ and the dynamic transducer part $M_2$ are mechanically connected to each other via a connecting element $E_1$ which is shown as a spring. Another connecting element $E_2$, which is shown as an attenuation element, provides for mechanical connection between the dynamic transducer part $M_2$ and the body part $B_2$.

In the embodiment shown in FIG. 2, the static transducer part $M_1$ and the dynamic transducer part $M_2$ are connected to each other via two connecting elements $E_1$ and $E_2$, of which the connecting element $E_1$ is a spring and the connecting element $E_2$ is an attenuation element. To couple the dynamic transducer part $M_2$ to the body part $B_2$, a connecting element $E_3$ is provided and is designed as a spring.

Additionally, other combinations of connecting elements can be used within the scope of the present invention. For example, instead of a spring element several other elements with different elastic properties can be used, and/or instead of a single attenuation element several such members each with differing attenuation characteristics in order to influence the frequency response in the desired manner can form the attenuation element. Regardless, provision is made for at least one of these connecting elements to be made as a multifunction element which is part of the support of the dynamic transducer part and/or part of an hermetically tight transducer housing.

One embodiment of the actuator hearing aid transducer of the invention is shown in FIG. 3. The manner of operation of the transducer is based on the inductive principle. The transducer which is labeled 10 throughout has a hermetically gastight and liquid-tight housing 11 of, for example, a circular cylindrical shape of biocompatible, gastight and liquid-tight material, such as titanium, gold or platinum. The transducer housing 10 includes a rigid, tubular peripheral wall 12 and two essentially round end walls, of which FIG. 3 shows only one. The latter end wall is formed by a flexible membrane 13 with an outside edge which is securely, hermetically and tightly connected to the peripheral wall 12. A rod 14 extends through a middle opening of the membrane 13 and is connected securely and hermetically tightly to the membrane 13 and projects out of the transducer housing 11 as the actuator element. The lengthwise axis of the rod 14 coincides with the lengthwise middle axis of the housing 11 and with the center of the membrane 13. A permanent magnet arrangement 15, which can include two permanent magnets, is attached to the rod 14. The two permanent magnets are magnetized in the axial direction which is indicated in FIG. 3 by the double arrow, and which is at the same time the direction of vibration of the dynamic part of the transducer. The permanent magnet arrangement 15 can preferably be packed biocompatibly and hermetically tight. For example, the permanent magnet arrangement 15 can be accommodated in its own housing of titanium, gold or platinum, shown in FIG. 9 as including concentric outside walls and inside walls 32 and 33. In this way, the body of the implant wearer is protected against toxic permanent magnet materials even if the membrane 13 which forms one part of the transducer housing should break. The inherent safety of the illustrated transducer design is thereby improved.

In the housing 11 sits a coil arrangement which is labeled 16 throughout, which is fixed with reference to the peripheral wall 12, and which can include three cylindrical ring coils which axially follow one another. The permanent magnet arrangement 15 is located within the axial space which is encompassed by the coil arrangement 16. The coil arrangement 16 produces the alternating electromagnetic field which drives the permanent magnet arrangement 15. Connections 17 for the coil arrangement 16 are routed out of the transducer housing 11 via hermetically tight feed-through means (not shown) at the end of transducer housing 11 opposite the membrane 13. When an alternating voltage signal is applied to the connections 17, the permanent magnet arrangement 15 together with the coupling rod 14 is forced into axial vibrations.

The coil arrangement and the permanent magnet arrangement which interacts with it can be built fundamentally in the manner shown in FIG. 3, but also differently, for example, in the manner known from U.S. Pat. No. 5,299,176 for transducers, which cannot be implanted.

The rod 14 and the permanent magnet arrangement 15 are supported to be axially adjustable to a limited degree with reference to the coil arrangement 16 by means of a support. The support in this embodiment includes the membrane 13 and another flexible, essentially round membrane 18. The membrane 18 sits on the end of the coil arrangement 16 which faces away from the membrane 13. The outside edge of the membrane 18 is likewise fixed with respect to the peripheral wall 12, and the rod 14 is attached in the middle opening 19 of the membrane 18 which is shown in an overhead view in FIG. 4. Differently than the membrane 13, the membrane 18 is not part of the hermetically tight transducer housing 11, but it lies axially, closely approximate the end wall of the housing 11 as shown in FIG. 3. The membrane 18 is provided with a sequence of concentric openings or perforations. The resulting circular ring segments 20 of the membrane 18 are connected to one another via crosspieces 21. The membrane 18 can be made of the same material as the membrane 13, for example from titanium, gold or platinum. Such a perforated membrane can assume a bearing function without noticeably influencing the frequency response of the transducer.

In the embodiment of FIG. 3, the coil arrangement 16 and the transducer housing, except for the membrane 13, form the static part $M_1$ of the transducer shown in FIGS. 1 and 2. This static transducer part, in the implanted state of the transducer, is essentially rigidly coupled to the skull bone of the implant wearer. The rod 14 and the permanent magnet arrangement 15 carried by it represent the dynamic transducer part $M_2$ of FIGS. 1 and 2. The membrane 13 corresponds to the connecting element $E_1$ of FIGS. 1 and 2, but at the same time also has a housing function and bearing function, and it is used to adjust the frequency response of the transducer 10. To implement the attenuating connecting element $E_2$ in FIG. 1, a corresponding attenuation element could be integrated into the coupling rod 14. Accordingly, the connecting element $E_2$ which has spring properties is implemented in FIG. 2 by a coupling rod 14 which is elastic in the axial direction and/or by inserting a spring element into this rod.

Figure 5:
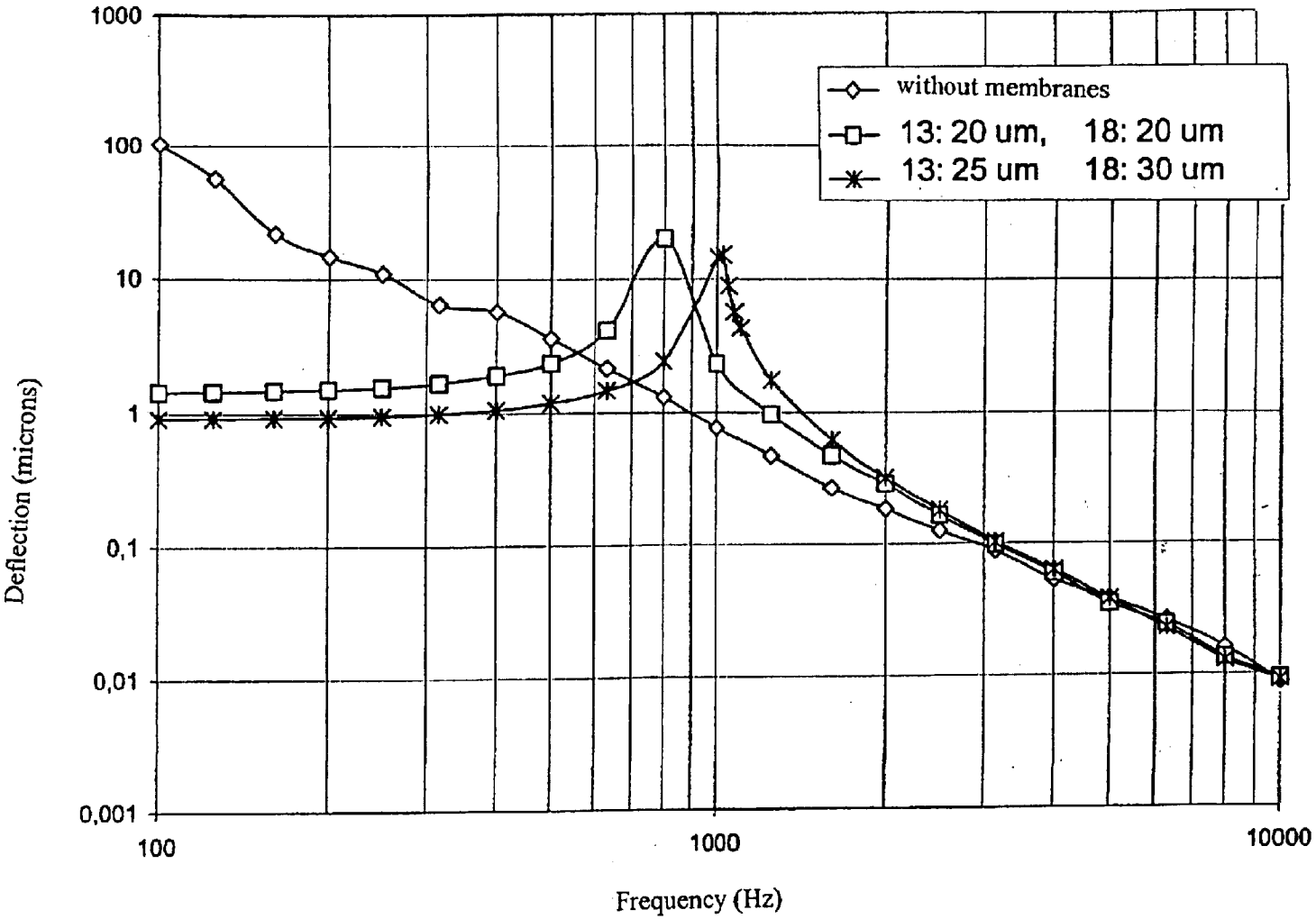
FIG. 5 illustrates the effect of the thickness of the transducer membrane, forming part of the hermetically tight housing shown in FIG. 3, on the frequency response of the transducer.

To achieve the desired frequency response of the transducer 10, the thickness of the membrane 13 which forms part of the hermetically tight housing 11 can be varied. FIG. 5 clearly shows the influence of the dimensioning of the membrane 13 of the transducer 10 as shown in FIG. 3 on the transducer frequency response. The transfer function of the experimental arrangement in which the two membranes 13 and 18 are omitted, which function is measured as a deflection in microns as a function of the frequency in Hz of the driver signal of the coil arrangement 16, is compared to the corresponding transfer functions which arise (a) when the membrane 13 which forms part of the hermetically tight housing with a thickness of 20 microns, and a bearing membrane 18 with a thickness of 20 microns are used, and (b) when the membrane 13 which forms part of the hermetically tight housing with a thickness of 25 microns, and a bearing membrane 18 with a thickness of 30 microns are used.

The resonance peak of the frequency response curves as shown in FIG. 5 is shifted significantly from roughly 800 Hz to roughly 1000 Hz when the thickness of the membrane 13 changes from 20 microns to 25 microns. The thickness of the bearing membrane 18 conversely has almost no effect on the frequency response.

Figure 6:
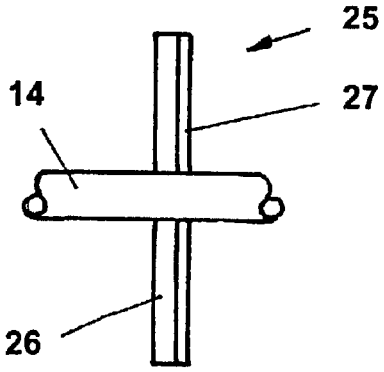
FIG. 6 shows a side view of a modified second membrane which is made as an attenuation element with a bearing function.

Instead of the bearing membrane 18, there can also be the membrane 25 which is shown schematically in FIG. 6; it has, in addition to the bearing function, also an attenuation property which influences the frequency response of the transducer in the desired manner. For this purpose, the membrane material can be an unperforated layer 26 of viscous material such as silicone. In order to ensure the bearing function, one such viscous membrane can be coated with a layer 27 of solid and preferably biocompatible elastic material, such as a duroplastic or metal, preferably titanium, gold, platinum or a mixture of at least two of these metals. This elastic coating layer 27 is perforated, preferably analogously to the perforation of the membrane 18 shown in FIG. 4. One such membrane 25 corresponds functionally to the connecting element $E_2$ of FIG. 2.

FIG. 7 shows the measured effect of a silicone membrane of FIG. 6 on the transfer function of an acoustic transducer. In FIG. 7, the thick curve plots the transfer function without the silicon membrane, while the thin curve plots the transfer function of the transducer with the silicone membrane 25. In the range below approximately 3000 Hz and above roughly 8000 Hz the membrane 25 acts to attenuate. In the range from roughly 4000 to 8000 Hz on the other hand the transducer deflection is intensified by the membrane 25.

Figure 8:
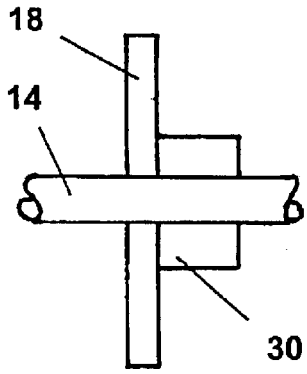

Within the scope of the transducer of the present invention, other connecting elements with an attenuation function are possible and can be used to influence the frequency response of the transducer. Thus, for the sake of example, FIG. 8 shows an attenuation element in the form of a circularly cylindrical plug 30 of viscous material, for example silicone. The plug sits, on the coupling rod 14, on the side of the membrane 18 facing away from the coil arrangement 16 as shown in FIG. 3. The plug 30 can be supported directly or indirectly on the rigid part of the transducer housing 11 and the motion of the dynamic transducer part $M_2$ in the axial direction can be influenced. A similar plug of viscous material can, for attenuation purposes, also lie against the axial end of the coupling rod 14 on the side of the membrane 18 facing away from the coil arrangement 16.

The isolated effect of such a plug is present in that large deflections of the dynamic transducer part $M_2$ are attenuated more strongly than small deflections. This action corresponds to relatively strong attenuation at low frequencies and relatively weak attenuation at high frequencies. This influence of the frequency response can also be useful in an actuator to improve hearing capacity, when for example signals below 250 Hz which are not needed for understanding speech are to be masked out.

In the embodiment of FIG. 8, the bearing function is carried out by the membrane 18 in conjunction with the membrane 13 as shown in FIG. 3. The attenuation element 30 itself does not need to develop any bearing action. According to a further modified embodiment, a viscous plug of the described type can also be configured such that it gives essentially only in the axial, but not in the radial direction. Then, the plug itself can assume the bearing and guide function for the dynamic transducer part, and the membrane 18 can optionally be omitted.

The use of several attenuation elements, for example, in the form of membranes and/or plugs of the explained type, can also be feasible depending on the use of the transducer as a sensor or as a transducer in the ultrasonic spectrum. An attenuation element by itself, analogously to the resonant element, can achieve its effect only in a limited range of the frequency spectrum. In contrast, several alternately designed attenuation elements make it possible to influence the spectrum in a controlled manner in several frequency ranges. If, for example, in the transducer as shown in FIG. 3, in addition to the attenuation of the frequencies below 250 Hz, frequencies above 4000 Hz are to be attenuated, i.e. signals with a frequency higher than that required for speech recognition, then such an attenuation can be achieved by a viscous plug 30 of the explained above being provided in addition to the metal-coated viscous membrane as shown in FIG. 6.

What is claimed is:

1. An implantable, electromagnetic hearing aid transducer, comprising:

a static transducer part including, a transducer housing hermetically sealed on all sides, and a ring coil arrangement fixedly mounted in the transducer housing;

a dynamic part, adapted to be coupled to a body part of an implant wearer, including, at least one connecting element forming a movable, mechanical connection relative to the static transducer part, and a permanent magnet arrangement which interacts with the ring coil arrangement to vibrate in the direction of an axis of the ring coil arrangement, wherein the at least one connecting element is a flexible membrane which is composed at least partially of a viscous material, said flexible membrane functioning as an attenuation connecting element and forming part of the wall of the hermetically sealed transducer housing and having mechanical properties which enable a member to be used to select the specifically set frequency response of the implantable transducer.

2. Implantable, electromagnetic hearing aid transducer as claimed in claim 1, wherein the flexible membrane used as the attenuation connecting element forms part of the support of the permanent magnet arrangement.

3. Implantable, electromagnetic hearing aid transducer as claimed in claim 1, wherein the flexible membrane used as the attenuation connecting element is composed of a layer of viscous material coated with a perforated layer of fixed, elastic material.

4. Implantable, electromagnetic hearing aid transducer as claimed in claim 3, wherein the material of the perforated layer is selected from the group consisting of titanium, gold, platinum and mixtures of at least two thereof.

5. Implantable, electromagnetic hearing aid transducer as claimed in claim 3, wherein the perforated layer comprises a duroplastic.

6. Implantable, electromagnetic hearing aid transducer as claimed in claim 1, wherein part of the support of the permanent magnet arrangement is a perforated flexible membrane located between the static transducer part and the dynamic part of the implantable transducer.

7. Implantable, electromagnetic hearing aid transducer as claimed in claim 1, wherein the permanent magnet arrangement is accommodated in its own, hermetically sealed, biocompatible housing.

8. Implantable, electromagnetic hearing aid transducer as claimed in claim 1, wherein the transducer housing is cylindrical in shape.

9. Implantable, electromagnetic hearing aid transducer as claimed in claim 8, wherein the transducer housing is circularly cylindrical.

10. An implantable, electromagnetic hearing aid transducer, comprising:

a static transducer part including, a transducer housing hermetically sealed on all sides and a ring coil arrangement fixedly mounted in the transducer housing;

a dynamic part, adapted to be coupled to a body part of an implant wearer, including, at least one connecting element forming a movable, mechanical connection relative to the static transducer part, and a permanent magnet arrangement which interacts with the ring, coil arrangement to vibrate in the direction of an axis of the ring coil arrangement, wherein the at least one connecting element is a multifunction element having at least one of the functions of forming at least part of a support for the dynamic part and part of the hermetically sealed transducer housing and further having mechanical properties selected for achieving a specifically set frequency response for the implantable transducer, and wherein part of the support of the permanent magnet arrangement is a perforated flexible membrane located between the static transducer part and the dynamic part of the implantable transducer.

11. Implantable, electromagnetic hearing aid transducer as claimed in claim 10, further comprising at least one attenuation element in the form of a plug of viscous material which interacts with the dynamic part of the implantable transducer.

12. Implantable, electromagnetic hearing aid transducer as claimed in claim 10, wherein the permanent magnet arrangement is mounted on a rod which is supported to be axially adjustable at two, spaced apart locations of the transducer housing by connecting elements.

13. An implantable, electromagnetic hearing aid transducer, comprising:

a static transducer part including, a transducer housing hermetically sealed on all sides, and a ring coil arrangement fixedly mounted in the transducer housing;

a dynamic part, adapted to be coupled to a body part of an implant wearer, including, at least one connecting element forming a movable, mechanical connection relative to the static transducer part, and a permanent magnet arrangement which interacts with the ring coil arrangement to vibrate in the direction of an axis of the ring coil arrangement, wherein the at least one connecting element is a multifunctional element having at least one of the functions of forming at least part of a support for the dynamic part and part of the hermetically sealed transducer housing and further having mechanical properties selected for achieving a specifically set frequency response for the implantable transducer, and wherein the permanent magnet arrangement is mounted on a rod which is supported to be axially adjustable at two, spaced apart locations of the transducer housing by connecting elements.

14. Implantable, electromagnetic hearing aid transducer as claimed in claim 13, wherein the at least one connecting element is a flexible membrane forming part of the wall of the hermetically sealed transducer housing and having a mechanical property which enables a member to be used to select the specifically set frequency response of the implantable transducer.

15. Implantable, electromagnetic hearing aid transducer as claimed in claim 14, wherein the transducer housing has a rigid tubular peripheral wall and end walls hermetically connected together, and wherein at least one of the end walls is formed by the flexible membrane via which the static transducer part and the dynamic pan are elastically connected to one another and which forms part of a support for the permanent magnet arrangement of the dynamic part.

16. Implantable, electromagnetic hearing aid transducer as claimed in claim 13, wherein one of the at least one connecting element functions as an attenuation element for attenuating the vibrational movements of the permanent magnet arrangement and wherein the mechanical properties of the attenuation element enable achievement of the set frequency response.

17. Implantable, electromagnetic hearing aid transducer as claimed in claim 13, wherein the rod fixedly caries the permanent magnet arrangement functioning as an actuator element and the rod projects out of the transducer housing.

18. An implantable, electromagnetic hearing aid transducer, comprising:

a static transducer part including, a transducer housing hermetically sealed on all sides, and a ring coil arrangement fixedly mounted in the transducer housing;

a dynamic part, adapted to be coupled to a body part of an implant wearer, including, at least one connecting element forming a movable, mechanical connection relative to the static transducer part, and a permanent magnet arrangement which is accommodated in its own, hermetically sealed, biocompatible housing and which interacts with the ring coil arrangement to vibrate in the direction of an axis of the ring coil arrangement, wherein the at least one connecting element is a multifunctional element having at least one of the functions of forming at least part of a support for the dynamic part and part of the hermetically sealed transducer housing and further having mechanical properties selected for achieving a specifically set frequency response for the implantable transducer.

19. An implantable, electromagnetic hearing aid transducer, comprising:

a static transducer part including, a transducer housing hermetically sealed on all sides, and a ring coil arrangement fixedly mounted in the transducer housing;

a dynamic part, adapted to be coupled to a body part of an implant wearer, including, at least one connecting element forming a movable, mechanical connection relative to the static transducer part, a permanent magnet arrangement which interacts with the ring coil arrangement to vibrate in the direction of an axis of the ring coil arrangement, a rod on which the permanent magnet arrangement is mounted, and at least one attenuation element in the form of a plug of viscous material which interacts with the dynamic part of the implantable transducer, wherein the at least one connecting element is a multifunctional element having at least one of the functions of forming at least part of a support for the dynamic part and part of the hermetically sealed transducer housing and further having mechanical properties selected for achieving a specifically set frequency response for the implantable transducer, and wherein the rod penetrates the plug of viscous material.

* * * * *